United States Patent [19]

Cummins et al.

[11] Patent Number: 4,474,675

[45] Date of Patent: Oct. 2, 1984

[54] PHOSPHINE OXIDES FOR USE AS FUNCTIONAL FLUIDS

[75] Inventors: Richard W. Cummins, Cranbury; Burton M. Baum, Princeton, both of N.J.

[73] Assignee: FMC Corporation, Philadelphia, Pa.

[21] Appl. No.: 451,360

[22] Filed: Dec. 20, 1982

[51] Int. Cl.[3] ..... C10M 3/38

[52] U.S. Cl. ..... 252/49.8; 252/78.5; 568/14

[58] Field of Search ..... 252/49.8, 78; 568/14

[56] References Cited

U.S. PATENT DOCUMENTS

| | | | |
|---|---|---|---|
| 2,612,513 | 9/1952 | Gluesenkamp et al. | 260/461 |
| 2,803,597 | 8/1957 | Stiles et al. | 204/158 |
| 2,822,376 | 2/1958 | Hechenbleikner et al. | 260/465.1 |
| 2,953,596 | 9/1960 | Rauhut et al. | 260/465.8 |
| 2,957,931 | 10/1960 | Hamilton et al. | 260/403 |
| 3,104,264 | 9/1963 | Willars | 252/49.8 |
| 3,591,501 | 7/1971 | Olszewski | 252/49.8 |
| 3,748,363 | 7/1973 | Maier | 252/49.8 |
| 4,315,867 | 2/1982 | Hänssle | 568/14 |
| 4,324,919 | 4/1982 | Elsner et al. | 568/8 |
| 4,328,163 | 5/1982 | Hänssle | 252/431 P |

OTHER PUBLICATIONS

Journal of Organic Chemistry, 1961—M. M. Rauhut et al.

*Primary Examiner*—Jacqueline V. Howard

*Attorney, Agent, or Firm*—Robert D. Jackson; Eugene G. Horsky

[57] ABSTRACT

Liquid tris(alkylcarboxyethyl) phosphine oxides, useful as the stock base for functional fluids, are described.

5 Claims, No Drawings

PHOSPHINE OXIDES FOR USE AS FUNCTIONAL FLUIDS

This invention relates to functional fluids such as hydraulic liquids, lubricants and the like. In particular, the invention pertains to certain liquid phosphine oxides for use as functional fluids.

Functional fluid is a term of art commonly applied for instance to lubricants and the working liquid in hydraulic devices and processes. Such materials, aside from their capacity to remain liquid under operating conditions, must be when formulated chemically inert to the extent that they do not attack or corrode metal surfaces, for example, bearings, journals, shafts, hydraulic cylinders, seals or other parts of the machinery in which they are used. They must also be thermally stable, exhibit suitable viscosity and flow characteristics and be compatible with the various additives commonly mixed with functional fluids to improve and/or modify their properties. Such additives include rust and corrosion inhibitors, antioxidants, viscosity modifiers, antifoam agents, copper passivators, etc.

In accordance with the present invention, it has been discovered that there can be used as the stock base for a functional fluid, a liquid tris(alkylcarboxyethyl) phosphine oxide of the formula:

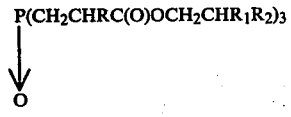

wherein R is hydrogen or methyl and wherein $R_1$, $R_2$ are each selected from the class consisting of hydrogen and alkyl of 2 to 5 carbon atoms, one of said $R_1$, $R_2$ always being alkyl.

The phosphine oxides of the invention, which belong to a class of known chemical entities, are prepared by reacting an acrylic ester with phosphine as depicted in the following scheme:

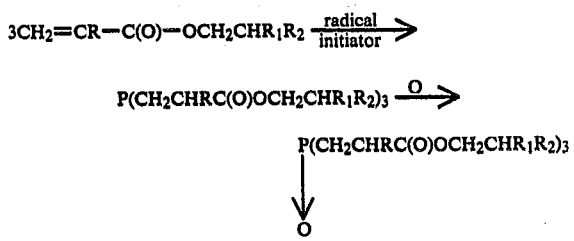

Generally speaking, the reaction sequence is carried out by introducing phosphine into a molar excess of the acrylic ester in the presence of the radical initiator under inert conditions at moderately elevated temperatures; about 80° C. to about 120° C. The resulting intermediate trialkyl phosphine is then oxidized, preferably with hydrogen peroxide, to the corresponding phosphine oxide. Suitable radical initiators include any number of compounds which are photochemically or thermochemically decomposed to form free radicals under the reactive conditions. A preferred radical initiator is azobisisobutyronitrile. Further details and examples of the reaction are set forth in U.S. Pat. No. 2,803,597 to Stiles and *J. Org. Chem.* 26, 5138 (1961).

The functional fluids of the invention will normally contain very minor amounts, typically about 0.01% to about 5.0% by weight of various additives of the type commonly incorporated in formulating hydraulic fluids and lubricants such as rust and oxidation inhibitors, corrosion inhibitors, antifoam agents, antiwear agents, and other special purpose additives.

Rust and corrosion inhibitors commonly employed include benzothiazole, benzotriazole, triethanolamine, phenothiazine, trialkyl phosphites, N-acrylsarcosines, propyl gallate, succinic acid and alkylsuccinic acids. Additives to inhibit foaming and cavitation include organosilicones, dialkyl carboxylic acid esters such as diethyl succinate or dioctyl sebacate. Anti-oxidants include dialkylthiodipropionate, for example, dilaurylthiodipropionate etc., organic amines, for example, diphenylamine, phenylnaphthylamine, hindered phenols, etc.

Particularly valuable features of the herein tris(alkyl carboxyethyl) phosphine oxides are their favorable viscosity index, good antiwear properties and low swelling action on Buna N elastomer, commonly used in the manufacture of seals in hydraulic machinery.

The invention is further illustrated by the following examples:

EXAMPLE 1

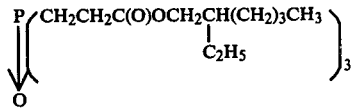

Tris(2-ethylhexylcarboxyethyl) Phosphine Oxide

To a 1-liter 316 SS stirred autoclave evacuated to 10 mm Hg pressure was added a solution of 0.4 g of azobisisobutyronitrile in 650.0 g (3.53 moles) of 2-ethylhexyl acrylate. While stirring 26.0 g (0.76 mole) of phosphine was added and the reaction mixture heated to 85° C.-90° C. and maintained at this temperature for 10 hours. A solution of 1.62 g of azobisisobutyronitrile dissolved in 100 g of toluene was added in two equal portions after the first and second hours of reaction.

At the end of the 10-hour reaction period, the reaction mixture was vacuum stripped at 100° C. and 30-50 mm Hg to remove toluene and unreacted acrylate. The residue was taken up in 600 ml of isopropyl alcohol and oxidized by dropwise addition of 60.0 ml of 30% hydrogen peroxide (0.53 mole). The oxidized product was vacuum stripped at 30° C. and 5 mm Hg to remove isopropyl alcohol and water yielding 571 g of product. Found: C, H, 10.47; P, 5.15. Molecular weight was 687 as compared to 602 for theory; acid number was 0.6. The product was oil-soluble and water-insoluble; its viscosity index was 86; pour point was −20° F.; specific gravity at 20/20° C. was 0.989.

EXAMPLE 2

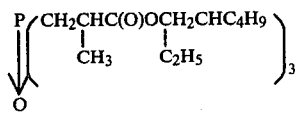

Tris(2-ethylhexylcarboxy-1-methylethyl) Phosphine Oxide

This compound is prepared by the procedure of Example 1 except 2-ethylhexyl methacrylate is substituted for 2-ethylhexyl acrylate.

EXAMPLE 3

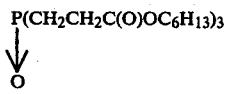

Tris(hexylcarboxyethyl) Phosphine Oxide

This compond is prepared by the procedure of Example 1 except hexyl acrylate is substituted for 2-ethylhexyl acrylate.

EXAMPLE 4

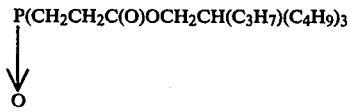

Tris(2-n-propylhexylcarboxyethyl) Phosphine Oxide

This compound is prepared by the procedure of Example 1 except 2-n-propylhexyl acrylate is substituted for 2-ethylhexyl acrylate.

What is claimed is:

1. A functional fluid composition comprising as the base stock, 95% to 99.99% by weight of a compound having the formula:

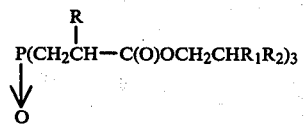

wherein R is hydrogen or methyl and wherein $R_1$, $R_2$ are each selected from the class consisting of hydrogen and alkyl of 2 to 5 carbon atoms, one of said $R_1$, $R_2$ always being alkyl; and in admixture with the base stock about 0.01% to 5% by weight of functional fluid additives.

2. A composition according to claim 1 wherein the compound of the formula is:

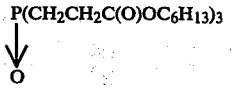

3. A composition according to claim 1 wherein the compound of the formula is:

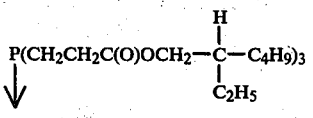

4. A composition according to claim 1 wherein the compound of the formula is:

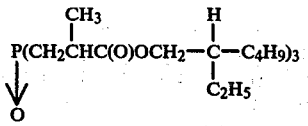

5. A composition according to claim 1 wherein the compound of the formula is:

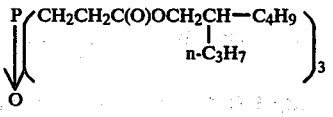

* * * * *

UNITED STATES PATENT AND TRADEMARK OFFICE

CERTIFICATE OF CORRECTION

PATENT NO. : 4,474,675

DATED : October 2, 1984

INVENTOR(S) : Richard W. Cummins and Burton M. Baum

It is certified that error appears in the above—identified patent and that said Letters Patent is hereby corrected as shown below:

Column 4, line 29,

" 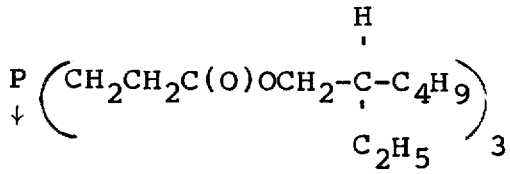 "

should read:

-- 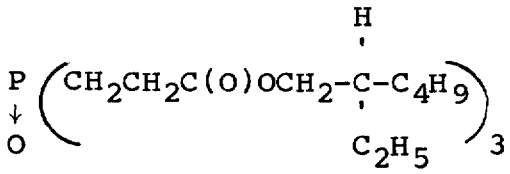 --

Signed and Sealed this

Sixteenth Day of July 1985

[SEAL]

*Attest:*

DONALD J. QUIGG

*Attesting Officer* *Acting Commissioner of Patents and Trademarks*